US006877337B2

(12) United States Patent
Francois et al.

(10) Patent No.: US 6,877,337 B2
(45) Date of Patent: Apr. 12, 2005

(54) PRODUCT FOR THE CLEANING OF REFRIGERATION INSTALLATIONS, METHOD AND DEVICE FOR PURGING OF THE SAME

(75) Inventors: Serge Francois, Morangis (FR); Francoise Brisset, La Varenne Saint Hilaire (FR)

(73) Assignee: DEHON SA, Paris (FR)

( * ) Notice: Subject to any disclaimer, the term of this patent is extended or adjusted under 35 U.S.C. 154(b) by 0 days.

(21) Appl. No.: 10/418,590

(22) Filed: Apr. 17, 2003

(65) Prior Publication Data

US 2004/0103682 A1 Jun. 3, 2004

(30) Foreign Application Priority Data

Apr. 17, 2002 (FR) ..... 02 04785

(51) Int. Cl.[7] ..... F25B 43/04; B08B 9/027; B08B 9/00; B08B 3/00

(52) U.S. Cl. ..... 62/475; 134/22.11; 134/22.12; 134/169 C; 134/166 C

(58) Field of Search ..... 62/292, 149, 77, 62/474, 475, 50.2; 165/95; 134/22.11, 22.12, 100.1, 169 C, 166 C

(56) References Cited

U.S. PATENT DOCUMENTS 3,947,567 A * 3/1976 Berg et al. ..... 424/45
4,222,886 A * 9/1980 Connelly, Jr. ..... 510/253
4,623,399 A * 11/1986 Frenier ..... 134/3
4,880,557 A * 11/1989 Ohara et al. ..... 510/189
5,179,840 A * 1/1993 Worsfold ..... 62/64
5,189,882 A * 3/1993 Morgan, Sr. ..... 62/77
5,265,629 A * 11/1993 Sajewski ..... 134/58 R
5,316,591 A * 5/1994 Chao et al. ..... 134/34
5,363,662 A * 11/1994 Todack ..... 62/85
5,390,503 A * 2/1995 Cheng ..... 62/125
5,415,003 A * 5/1995 Bertva et al. ..... 62/85
5,507,969 A * 4/1996 Shinohara et al. ..... 510/400
5,761,912 A * 6/1998 Popp et al. ..... 62/51.1

* cited by examiner

*Primary Examiner*—William C. Doerrler
(74) *Attorney, Agent, or Firm*—Quarles & Brady LLP

(57) ABSTRACT

The invention relates to a cleaning fluid for a refrigeration plant, characterized in that it comprises a cleaning oil mixed with a liquefied carrier gas with which it forms, by expansion, a cleaning foam, for example the oil is a POE or a PAG and the gas is R134a.

The invention also relates to a cleaning method. This comprises the following steps: the step of creating a foam from the oil and a liquefied gas in which it is at least partly miscible; the step of making the foam circulate in the said component; and the step of extracting the foam. In particular, the plant is rinsed with the gas separated from the cleaning foam, in order to remove the oil residues.

18 Claims, 4 Drawing Sheets

PRODUCT FOR THE CLEANING OF REFRIGERATION INSTALLATIONS, METHOD AND DEVICE FOR PURGING OF THE SAME

FIELD OF THE INVENTION

The invention relates to the field of refrigeration plants in which a refrigeration circulates in a closed circuit. The subject of the invention is in particular a means for cleaning the equipment.

BACKGROUND ART

The plants to which the present invention relates comprise a closed circuit in which a refrigerant circulates, the latter being driven by means of a compressor of the lubricated type. Because of the lubrication requirements of the compressor, it is known to introduce a lubricating oil into it.

Correct operation of the plant is determined by a clean state of the internal surfaces of the circuit. It is up to its operator to eliminate any impurities liable to be entrained by the refrigerant. The origin of the formation of these impurities lies in incidents in the operation of the motor in sealed units or accessible sealed units and the formation of scale as a result of these, the presence of water in the circuit, the formation of acid, the degradation of the lubricating oil or else the formation of oxides at welded or brazed joints when they were produced without having removed beforehand any oxygen trapped in the pipes.

A cleaning operation is therefore already necessary upon commissioning a new plant, or subsequently after a fault that has contaminated the circuit has been repaired.

Hitherto, the Applicant has used for these cleaning operations a product of the R141b type, that is to say a 1,1-dichloro-1-fluoroethane, having a high solvent power (KB=51) and a low surface tension (18.4 mN/m), this product being suitable for cleaning the surfaces of metals, plastics and composites. In the liquid state, it is not inflammable and it is packaged in 28 kg bottles pressurized under dry nitrogen (7 bar). To carry out cleaning, the liquid outlet of the bottle is connected to the component of the plant to be cleaned, for example a tube exchanger. The outlet of the component is connected to a recovery drum via a hose. This drum is itself maintained at atmospheric pressure, being connected to the open air via a nozzle that allows the nitrogen and any vapours of the product to be discharged. Venting is sufficient since the product has, under the operating conditions, a low vapour pressure, its boiling point being above 30° C.

The cleaning operation consists in circulating the fluid by opening the tap on the bottle. The fluid is then propelled by the pressurized gas. Optionally, the circulation is activated with the creation of pressure surges in the fluid, by rapidly and repeatedly opening and closing the valve. The supply of fluid is stopped when the liquid recovered in the drum runs clear. The plant is then clean.

Because of the regulations now in force limiting the use of HCFC fluids, it has become necessary to use a replacement product.

The replacement product must have the same properties as the previous one. It must be a solvent for the products involved in the plants, must not be inflammable under the operating conditions, must be extractable, must have a low viscosity and not leave residual traces or at least traces compatible with the refrigerants and lubricating oils used in the refrigeration circuit. It must also be inexpensive.

Cleaning oils based on a polyol-ester (POE) or especially a polyalkylene glycol (PAG), that have the stripping properties and the low viscosity that are required for this application, are known. They are also compatible with the refrigerant used in the circuit. In particular, they are used for the conversion of plants to take the new statutory refrigerants. In circulation in a closed circuit, the amount is around 1%, at most 3%. However, their use in cleaning operations, where they are used in more substantial proportions, is unsatisfactory as they are very difficult to extract from the circuit. Furthermore, a non-extractable oil residue remains, which may impair proper operation or even cause machine breakage.

The subject of the invention is therefore a cleaning fluid for refrigeration plants that does not have this drawback.

SUMMARY OF THE INVENTION

According to the invention, the cleaning fluid is characterized in that it comprises a liquid cleaning oil mixed with a liquefied carrier gas with which it forms, by expansion, a cleaning foam. Advantageously, the carrier fluid is based on a hydrofluorocarbon. In particular, it is the product R-134a (1,1,1,2-tetrafluoroethane) and the cleaning agent is a POE or PAG oil. Other products are covered by the invention.

For example, apart from R-134a, the following fluids may be used: R-125, R-245fa, R-245ca, R-236ea, R-236fa and RC318, by themselves or else as a mixture containing these fluids: R-404A, R-404B, . . . , R-404E, R-413A, R-417A, R-507. However, the fluid R-134a is the most appropriate for the present application.

According to another feature, the cleaning fluid consists of 10 to 80% cleaning oil and 90 to 20% liquefied gas. Preferably, it consists of 20 to 40% cleaning oil and 80 to 60% liquefied gas.

Because of its use in the form of a foam, this cleaning fluid has the advantage, in addition to its solvent power, of acting mechanically to detach and entrain the impurities in the circuit into which it is injected. Moreover, in this form, the amount of cleaning oil contained in the circuit during the cleaning operation and consequently the amount of residual product that it is necessary to extract after cleaning are limited. Furthermore, it is possible to use the liquefied gas by itself to rinse the circuit thanks to its miscibility with the cleaning agent.

Advantageously, the fluid is held in a container under pressure—4 bar minimum, 10 bar maximum—so that it forms a foam when it is extracted from the container.

The subject of the invention is also a method of cleaning a refrigeration plant. The method is characterized in that it comprises the following steps: the step of creating a foam from the oil and a carrier fluid; the step of making the foam circulate in the said component; and the step of extracting the foam.

According to another feature, the extraction step is carried out by circulating, in the component to be cleaned, an extraction fluid at least partly miscible with the cleaning oil. In particular, the extraction fluid is formed from the carrier fluid that has been separated from the foam. This method has, among other advantages, that of operating in a closed circuit, with no discharge into the atmosphere.

According to a preferred method of implementation, the foam, after being extracted from the component, is collected in a recovery container, and the carrier fluid is circulated in the said component by means of a transfer machine. The carrier fluid is extracted in gaseous form from the said container, and then liquefied before being injected into the component of the refrigeration plant.

Preferably, the method includes an initial step of connection to a vacuum source. It also includes a final step of purging by means of the transfer machine.

The invention also relates to a device for implementing the method by means of a cleaning fluid. It comprises a source of cleaning fluid, a means of recovering the cleaning fluid, lines that connect the said source with an inlet of the component of the refrigeration plant to be cleaned, pipes that connect an outlet of the component to be cleaned with the recovery means, and valves that control the said connections.

Advantageously, it includes a transfer machine, that can be interposed by means of valves between a gas outlet of the recovery means and the inlet of the component, in order to carry out the rinsing step. In particular, the device includes a vacuum pump that can be connected via valves to the entire cleaning circuit in order to create a vacuum.

In a preferred embodiment, the device comprises a block composed of the said valves with means of connection to at least the source of cleaning fluid, the means of recovery, a transfer machine, a vacuum pump or the component of the refrigeration plant to be cleaned.

BRIEF DESCRIPTION OF THE DRAWINGS

The invention will be described in detail, bringing out other features and advantages, with reference to the appended drawings, in which.

DESCRIPTION OF THE DETAILED DESCRIPTION

Figure 1:
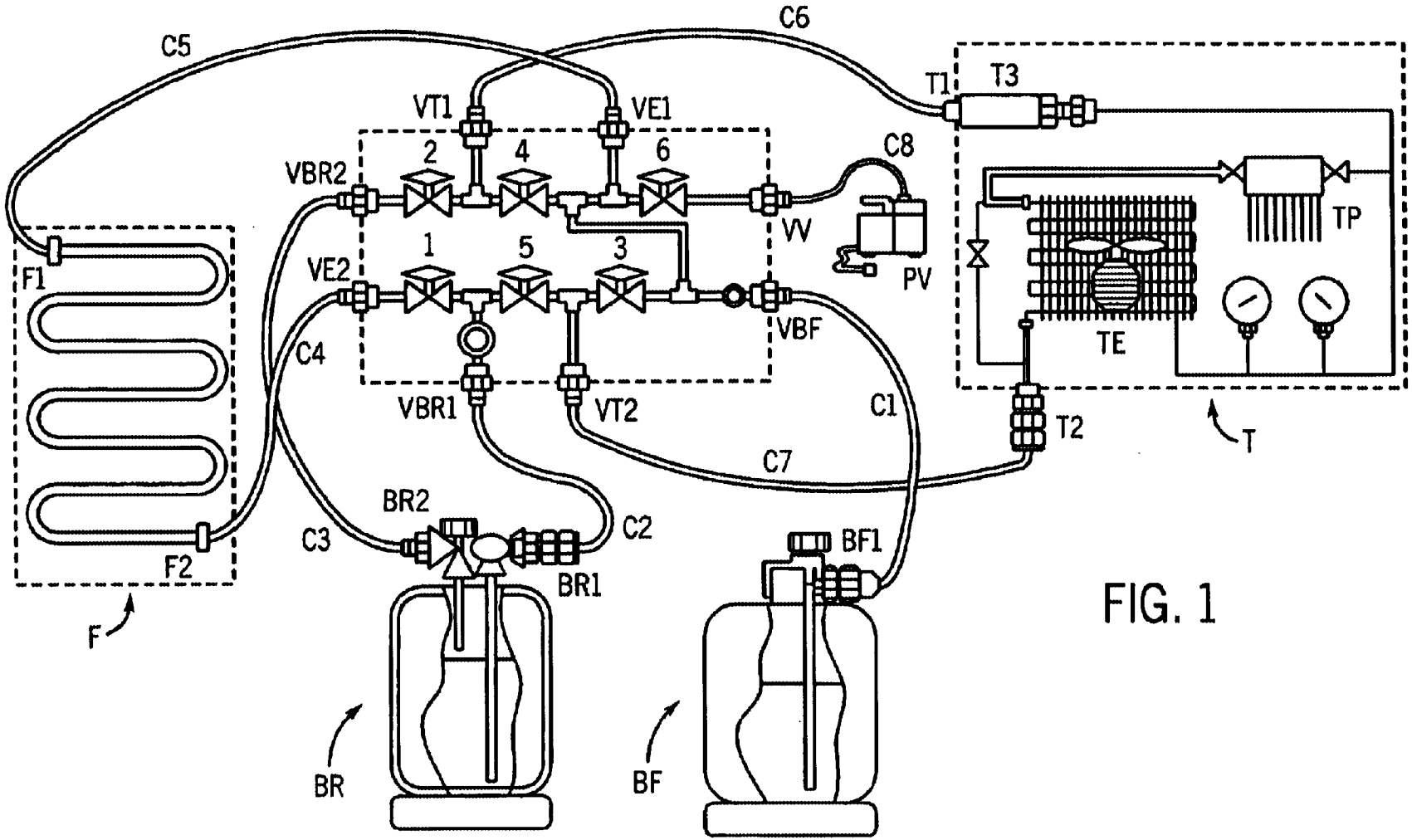
FIG. 1 shows schematically a device for cleaning a refrigeration plant.

Referring firstly to FIG. 1, this shows a component of a refrigeration plant F to be cleaned. Shown here is a tube in the form of a coil, with an inlet F1 and outlet F2. The invention is not limited to the cleaning of a single component; it is possible to clean all or part of a plant.

The source of cleaning fluid is shown by a bottle BF. It has a tap BF1 for controlling the extraction of the cleaning fluid FN, the liquid phase and gas or vapour phase of which have been shown by imaging the bottle to be transparent. The tap controls the flow through a tube dipping into the liquid phase. The cleaning fluid consists of a mixture of cleaning oil and liquefied gas.

The function of the cleaning agent is to dissolve the lubricating oil to be extracted, and to entrain water, acids and contaminants. The cleaning oil is a synthetic oil, preferably one based on a polyol ester (POE) or a polyalkylene glycol (PAG). These products are commercially available, in the case of POE, for example under the brand names PLANETELF ACD from TotalFinaElf, ARCTIC EAL from Exxon Mobil or EMKARATE RL from ICI-Emkarate and, in the case of PAG, for example under the brand names PLANETELF PAG488, PLANETELF PAG244 and PLANETELF PAG SP20 from Totalfinaelf or EMKARAOX RL from ICI-Emkarate. It may also be a benzene alkyl or a mineral oil. This agent is not volatile. Under the operating conditions, it has a low viscosity, up to 68 centistokes at 40° C. in practice.

The liquefied gas must have a boiling point at ambient pressure below 20° C. and preferably below −20° C. or even lower. However, it then becomes more expensive and less economically beneficial.

The cleaning oil is mixed with the liquefied gas in which it is miscible. A minimum amount of agent is required in the mixture in order to obtain a foam and a minimum amount of gas is needed in order to obtain pressure. The content of cleaning oil is between 10% and 70%. However, in practice it is advantageous to use a mixture of 20 to 40% cleaning oil and 80 to 60% liquefied gas. The fluid R-134a is the preferred liquefied gas.

Shown beside this bottle is the means of recovering the cleaning fluid, which is also a bottle BR. This has two taps BR1 and BR2. The tap BR1 controls the flow through a tube dipping into the liquid phase of the recovered fluid and the tap BR2 controls the flow through a shorter tube communicating with the gas phase of the recovered fluid.

A self-contained transfer machine T includes a pump TP, which is preferably a dry piston pump or a diaphragm pump as it requires no lubricating oil. The use of an open, sealed or accessible sealed compressor is conceivable, but there is a risk of contamination, and it requires the oil level to be monitored. The machine also includes a ventilated exchanger TE. The fluid to be transferred, initially in the vapour state, is taken into the machine via an inlet T1 which is provided with a filtering means T3. It passes in succession through the pump, then into the exchanger where it is cooled until liquefaction, and is discharged via the outlet T2.

The device of the invention includes a block V comprising six valves V1 to V6 and internal pipes communicating with six pipe couplers: VT1, VBR1, VE2, VBR2, VT2, VE1, VV, VBF. The term "block" is understood to mean any assembly comprising the various members. These may, for example, be mounted on a support plate. The valves are two-way valves with a manual control. The valves V1, V3 and V5 are placed in series, as are the valves V2, V4 and V6.

The valve V1 is placed in series with the coupler VE2 on one side and with the valve V5 on the other. The valve V5 communicates with the valve V3, which is connected to the coupler VBF. Above these, the valve V2 is in series with the coupler VBR2 on one side and with the valve V4 on the other. The latter communicates with the valve V6, which is connected to the coupler VV.

The coupler VBR1 corresponds to the pipe connecting the valves V1 and V5, the coupler VT2 with the pipe connecting the valves V5 and V3, the coupler VT1 with the pipe connecting V2 and V4, and the coupler VE1 with the pipe connecting V4 and V6. A pipe connects the pipe placed between the valves V4 and V6 with the pipe placed between the valve V3 and the coupler VBF.

The couplers allow the connection of external hoses, for example flexible hoses, for bringing the various valves into communication in the manner explained later. The couplers may be of the quick-acting type.

The hose C1 connects the tap BF1 of the cleaning fluid bottle to the coupler VBF; the hose C2 connects the tap of the recovery bottle BR1 to VBR1; the hose C3 connects the tap BR2 to VBR2; the hose C4 connects the coupler VE2 to an inlet F2 of the component to be cleaned; the hose C5 connects VE1 to another inlet F1 of the component; the hose C7 connects VT2 to the outlet T2 of the transfer machine; and the hose C6 connects VT1 to the inlet T1 of the transfer machine. Finally, the hose C8 connects VV to a vacuum pump PV.

The procedure for cleaning a component of a refrigeration plant is carried out in the following manner. The connections have been made as shown in FIG. 1. All the taps are closed.

A heating sleeve is placed around the bottle B so as to maintain it at a temperature between 20° C. and 50° C. depending on the room temperature. The bottle contains, for example, 30% POE oil and 70% liquefied gas such as R-134a which, on expanding through the oil, can foam the latter. The liquefied gas chosen also has the property of being miscible with the cleaning oil.

The operation is started by firstly creating a vacuum in the entire circuit. The taps on the bottles are closed. The six valves are opened and the vacuum pump PV turned on. The vacuum does not need to be a high vacuum; when the pressure gauge of the pump indicates −1 bar, the valve V6 is closed and the pump stopped.

Figure 2:
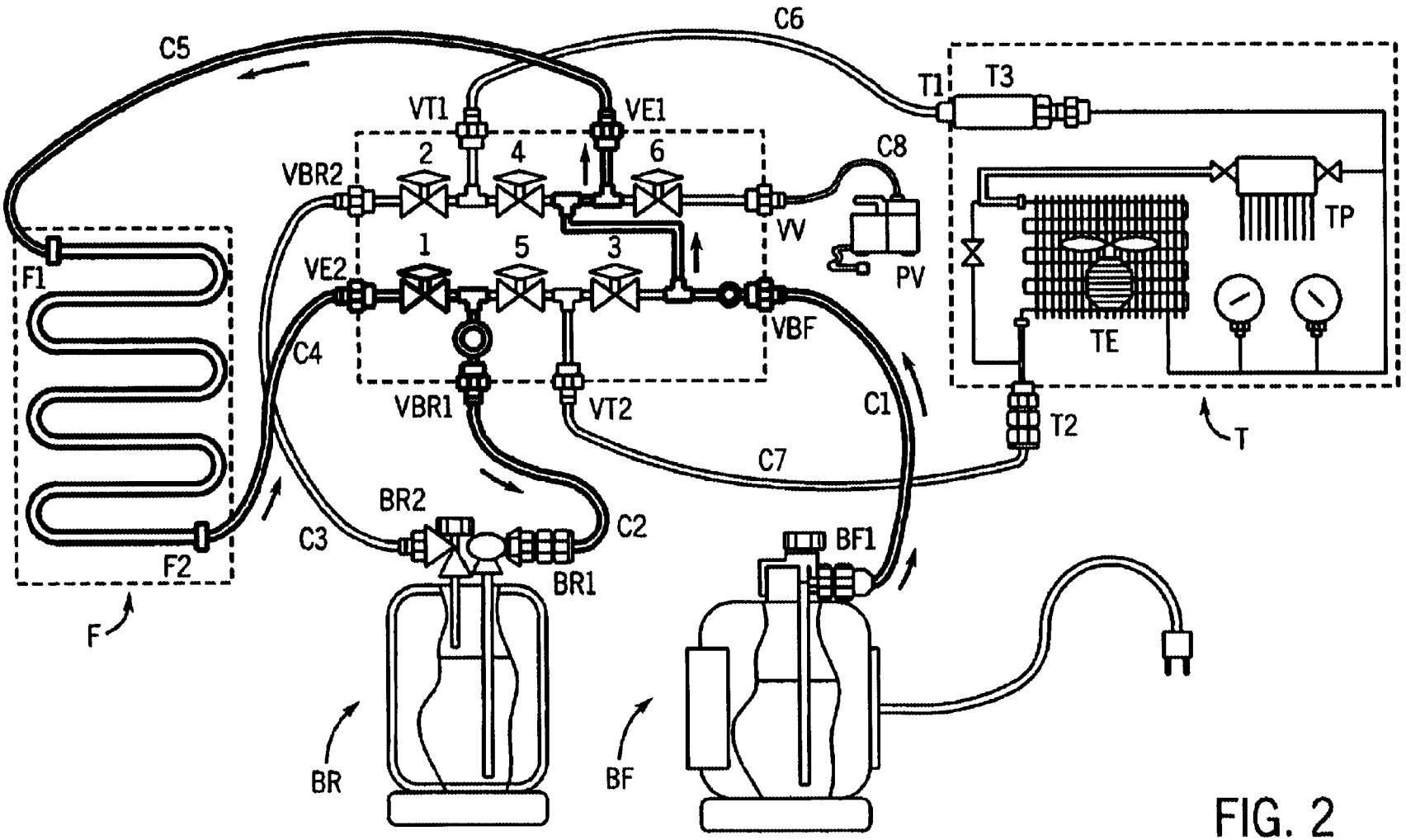
FIGS. 2 to 4 show the various stages of cleaning with the circulation of the fluids.

The circulation of the fluids during the cleaning phase is shown in FIG. 2. The valves V2, V3, V4, V5 and V6 are closed. The valve V1 remains open. The tap BF1 is opened. This has the effect of allowing the liquefied gas to expand. On passing through the liquid phase FNL, it forms a foam. The foam formed from the oil/gas mixture is therefore driven into the circuit, which is under vacuum. A short time afterwards—the time for the pipes to fill—the tap BR1 on the recovery bottle is opened. The foam expelled from the bottle BF travels along the lines C1 and C5 before entering the refrigeration plant.

The combined effect of the stripping/detergent POE oil and the abrasive foam is that particles or waste products adhering to the walls are detached. The circulation and the state of the fluid may be monitored by looking through the inspection windows located near the two couplers VBF and VBR1. When the fluid has a sufficiently clear appearance, the cleaning phase is stopped by closing the tap BF1.

Figure 3:
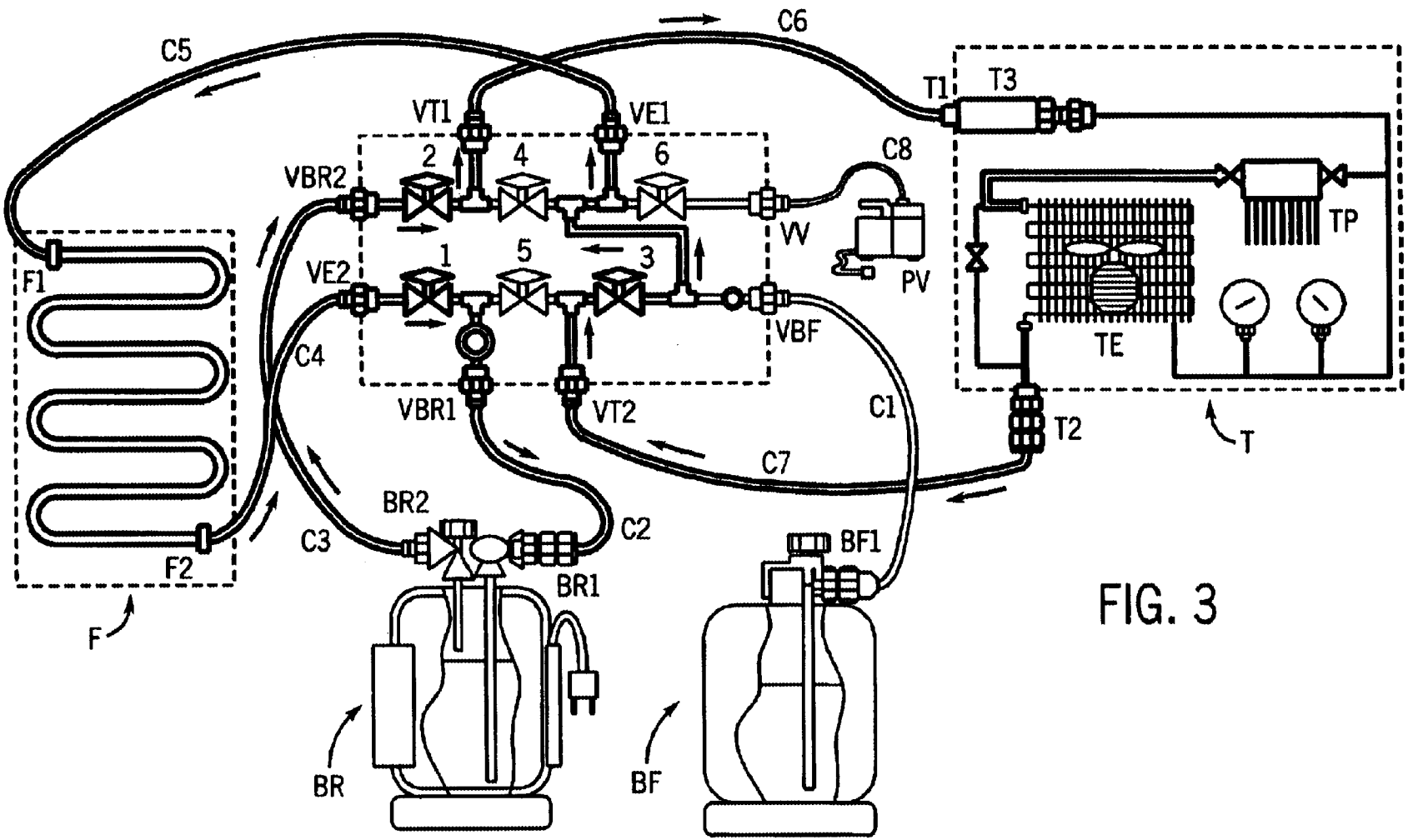

Next, the rinsing procedure is carried out in order to remove the rest of the cleaning oil foam that was deposited in the circuit. For this, reference will now be made to FIG. 3. The valves V4, V5 and V6 are closed. The valves V1, V2 and V3 and the tap BR2 are opened. A heating jacket is placed around the bottle BR in order to encourage the vaporisation of the liquefied gas from the mixture collected in the bottle. In the case of the gas R-134a, it is sufficient to heat to 30° C. The compressor TP of the transfer machine is turned on. The machine sucks out the gas phase in the bottle BR. The gas phase therefore comprises only the gas separated from the oil. It follows the lines C3 and C6, enters the machine through the filter T3, is compressed by the piston of the self-lubricated compressor, and is then cooled in the exchanger TE sufficiently to liquefy it.

The liquefied gas flows along the line C7 and passes through the component F. Because of its miscibility with the cleaning oil, and the fact that at the inlet of the component it has an oil content close to zero, it absorbs any trace of oil that is encountered in the circuit, until becoming saturated. It is then returned to the recovery bottle BR where the liquid phase is deposited on the bottom. The rinsing is continued until no more foam is observed through the inspection window of the coupler VBR1.

Figure 4:
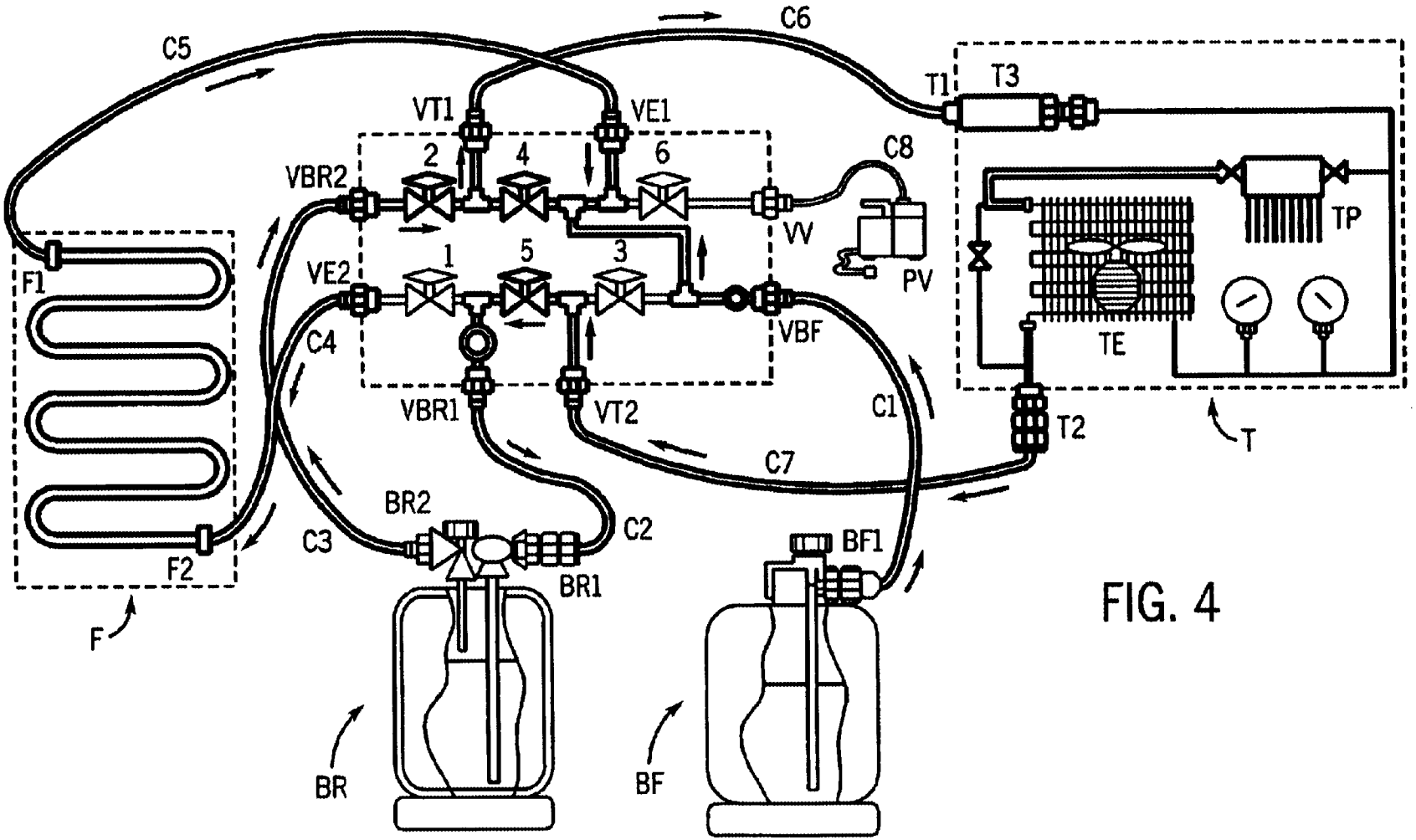

The cleaning operation is completed by purging the lines. FIG. 4 shows the circulation of the fluids. The tap BR2 on the recovery bottle, the tap BF1 on the cleaning fluid bottle and the valves V1, V3 and V6 are closed. The valves V2, V4 and V5 are opened. The transfer machine is turned on. The aim of the vacuum created is to drain all the lines and the component of the refrigeration plant. The mixture is delivered by the compressor of the transfer machine to the recovery bottle. The machine is stopped when its pressure gauge indicates a given pressure that is estimated to be satisfactory, for example 0.15 bar relative.

The system is then ready for a further operation.

A method of implementation has been described in which the valves are controlled manually. The invention also applies to the case in which control is managed automatically by using solenoid valves.

Several tests were carried out to check the method, using a product composed of POE oil and R134a fluid.

The measured values of the saturation vapour pressure for various compositions and at various temperatures are given in the table below:

| Composition | % by weight | | | | | | | |
|---|---|---|---|---|---|---|---|---|
| Oil | 5 | 10 | 30 | 40 | 60 | 70 | 80 | 90 |
| R134a | 95 | 90 | 70 | 60 | 40 | 30 | 20 | 10 |
| Temperature | Relative pressure expressed in bar | | | | | | | |
| 0° C. | 0.4 | 0.7 | 1.4 | 1.5 | 1.6 | 1.7 | 1.75 | 1.8 |
| 20° C. | 1 | 1.8 | 3.3 | 3.7 | 4.1 | 4.3 | 4.4 | 4.5 |
| 30° C. | 1.9 | 2.7 | 4.7 | 5.7 | 5.9 | 6.2 | 6.4 | 6.5 |
| 50° C. | 2.5 | 4.2 | 8.4 | 9.5 | 11.1 | 11.6 | 11.9 | 12.1 |

During storage, the mixture is a single-phase liquid at all temperatures between 0° C. and 50° C. and for all the proportions tested. The foam is formed by expansion. The foaming effect of the mixture is strong when it contains between 10 and 80% oil. It rapidly decreases away from these proportions.

A mixture having the proportions of ⅓ POE oil and ⅔ R134a was used.

Cleaning a New Window Air Conditioner

The volume of the refrigeration circuit was 4 liters. The fluid was driven by a hermetically sealed compressor.

The circuit was filled with product by making it flow in the normal direction of operation of the machine. The product was recovered at the outlet of the suction pipework and collected in the recovery bottle via a transparent flexible PVC hose. The state of the fluid leaving the circuit could then be checked. 5 kg of product were used.

After cleaning, about 0.6 kg of product remained to be recovered from the plant, i.e. 0.2 kg of oil. The rinsing procedure of the invention was applied, using a transfer machine (RD2000 brand) for about 16 minutes. This corresponded to the passage of 0.7 kg of R134a, a sufficient amount to absorb the oil.

The plant was then purged, by closing the valve on the recovery bottle. The operation was stopped when the pressure gauge indicated 0.2 bar relative.

On weighing the apparatus, no appreciable difference from the situation before the treatment was observed. This meant that the oil had been recovered.

Cleaning an Evaporator Consisting of 14 Tubes on 4 Rows

The volume of the circuit was 4 liters.

The circuit was filled with product, making it flow in the normal direction of machine. The product was recovered at the outlet of the recovery pipework via a transparent flexible PVC hose. It was found that the circuit was substantially fouled.

To facilitate the flow of the product in the circuit and obtain a high enough pressure for the cleaning product, the bottle was heated by means of a heater. 3.8 kg of product were used before obtaining a clean foam as output.

After cleaning, about 0.3 kg of product remained in the evaporator. This corresponded to 0.1 kg of oil.

The cleaning procedure according to the invention was carried out for about 8 minutes. This time corresponded to a passage of 0.35 kg of R134a, an amount sufficient to absorb the oil. The plant was purged as previously. By weighing, it was confirmed that the oil had been recovered.

Cleaning a Negative Cold Chamber

The plant comprised an evaporator with a finned battery, of the Morgana brand, and a Copeland compressor of 18.13 $m^3/h$ capacity. The volume of the circuit was 28 liters and that of the chamber was 5 $m^3$. The circuit contained 3.5 kg of FX10, which is a transition fluid.

The compressor, the liquid anti-blow bottle and the oil separator were separated, in order to clean them separately. The thermostatic expander was dismantled in order to replace it with a brazed tube so as to provide a good supply flow. The dehydrator was likewise replaced with a tube.

The procedure was as in the previous cases. The circuit was not greatly fouled. 19.29 kg of product were required. 8 kg of this remained to be recovered. The system was rinsed using the same procedure as in the previous cases, for 1 hour 30 minutes, i.e. 8 kg of R134a. After the circuit had been purged, it was found that 19.1 kg of the 19.29 kg injected had been recovered. It was estimated that the difference came from the couplers that were not perfectly sealed.

What is claimed is:

1. Cleaning fluid for internal surfaces of a component of a refrigeration plant, characterized in that the cleaning fluid comprises a cleaning oil mixed with a liquefied carrier gas to form, by expansion, a cleaning foam that when introduced into the component is free of water and then entrains any water contained in the component.

2. Fluid according to claim 1, in which the liquefied gas has a boiling point at atmospheric pressure below 20° C., preferably below −20°C.

3. Fluid according to claim 1 or 2, the liquefied gas of which is based on a hydrofluorocarbon.

4. Fluid according to claim 1, in which the oil is miscible, at at least 10%, especially between 15 and 40%, in the liquefied gas.

5. Cleaning fluid according to claim 1, in which the gaseous carrier fluid is chosen from the products R-134a, R-125, R-245fa, R-245ca, R-236ea and R-236fa, considered separately or as a mixture.

6. Cleaning fluid according to claim 1, in which the cleaning oil is a synthetic oil, especially of a POE, PAG or alkyl benzene type.

7. Cleaning fluid according to claim 1, consisting of 20 to 40% cleaning oil and 80 to 60% liquefied gas.

8. Cleaning fluid according to claim 1, contained in a pressure-resistant container so that it forms a foam when it is extracted from the container, to be circulated through the component to be cleaned.

9. Method of cleaning a component of a refrigeration plant using a cleaning oil, characterized in that the method comprises the following steps: the step of creating a foam from the cleaning oil and a liquefied gas in which it is a least partly miscible; the step of making the foam circulate in the said component; and the step of extracting the foam from the component.

10. Method according to claim 9, in which the extraction step is carried out by circulating, in the component, an extraction fluid at least partly miscible with the cleaning oil.

11. Method according to the preceding claim 10, in which the extraction fluid is at least partly formed from the said liquefied gas.

12. Method according to claim 10, in which, after the foam has been extracted from the component, this foam is collected in a recovery container and extracted from this container is the gas phase that is made to circulate through the said component.

13. Method according to claim 10, in which the said gas phase is extracted by a transfer machine in which the gas is liquefied before it circulates through the said component.

14. Method according to claim 9, including an initial step of connection to a vacuum source.

15. Method according to claim 9, including a final step of purging the component with a transfer machine.

16. The method of claim 9, further comprising implementing the method of cleaning a component of a refrigeration plant with a device, the device comprising a source of cleaning fluid, a means of recovering the cleaning fluid, lines that connect the said source with an inlet of the component to be cleaned, pipes that connect an outlet of the component to be cleaned with the means for recovering, and valves that control said connecting lines.

17. The method to according to claim 16, further comprising interposing a transfer machine, water valves between a gas outlet of the recovery means and the inlet of the component, in order to carry out a rinsing step with the liquefied gas.

18. The method according to claim 16, further comprising connecting a block composed of the said valves with means of connection to at least one of the following parts: the source of cleaning fluid, the means of recovery, a transfer machine, a vacuum pump or the component of the refrigeration plant to be cleaned.

* * * * *